United States Patent [19]

Gandillet

[11] 3,979,992

[45] Sept. 14, 1976

[54] BOWS FOR STRINGED INSTRUMENTS

[75] Inventor: André Gandillet, Carmaux, France

[73] Assignee: C.A.T. Ary-France, France

[22] Filed: Apr. 22, 1975

[21] Appl. No.: 570,929

[30] Foreign Application Priority Data

Apr. 29, 1974 France ..... 74.15306

[52] U.S. Cl. ..... 84/282

[51] Int. Cl.[2] ..... G10D 1/02

[58] Field of Search ..... 84/282, 297 R

[56] References Cited

UNITED STATES PATENTS

| | | | |
|---|---|---|---|
| 764,558 | 7/1904 | Carlson | 84/282 |
| 1,461,096 | 7/1923 | Rigg | 84/282 |
| 1,646,118 | 10/1927 | Stadniczek | 84/282 |
| 1,655,613 | 1/1928 | Jung | 84/282 |
| 2,263,793 | 11/1941 | Woerner | 84/282 |
| 2,483,486 | 10/1949 | Brown | 84/282 |

FOREIGN PATENTS OR APPLICATIONS

| | | | |
|---|---|---|---|
| 1,515,007 | 1/1968 | France | 84/282 |
| 610,310 | 3/1935 | Germany | 84/282 |
| 6,221 | 1914 | United Kingdom | 84/282 |

*Primary Examiner*—Stephen J. Tomsky
*Attorney, Agent, or Firm*—Bucknam and Archer

[57] ABSTRACT

The present invention relates to the assembling of the conventional hair on a bow of a stringed instrument, particularly a violin, wherein a cavity is made in the nut in which is fixed a moulded piece comprising an internal housing of such section as to ensure that the twisted end of the hair is retained by a stop, itself made by moulding. The opposite end of the hair is fixed to the head of the bow, in the same manner. The invention is applicable in the musical instruments industry.

5 Claims, 4 Drawing Figures

BOWS FOR STRINGED INSTRUMENTS

The present invention relates to improvements in bows for stringed instruments.

The manufacture of bows, and more particularly the assembling of the ends of the hair on the head and on the nut are known to be very delicate operations which require specialised and highly skilled manpower, which is becoming more and more rare at the present time.

The improvements which form the subject matter of the present invention have for their particular object to remedy the above-mentioned drawback and to allow bows whose quality is at least equal to that of the conventional articles to be made simply and economically.

In accordance with the invention, to assemble the twisted ends of the hair on the head and on the nut of the bow, a suitably sectioned cavity is made in each of the said elements, a hollow piece obtained by moulding is then fixed in said cavity and, finally, the corresponding twisted end of the hair is blocked with the aid of a stop retained by wedging in the housing provided inside the above-mentioned piece.

The cavity provided in the nut and in the head of the bow may be obtained very simply with the aid of conventional rotating tools (mill or the like), without any particular ability being necessary. Furthermore, the piece intended to be fixed in this cavity may, due to its production by moulding, be of any desired shape and section, no subsequent rectification being necessary. Finally, the introduction of the stop, itself advantageously obtained by moulding, does not present any particular difficulty due to the exactitude of the section of this stop and the housing provided in the corresponding piece.

The invention will be more readily understood on reading the following description with reference to the accompanying drawings, in which.

Figure 2:
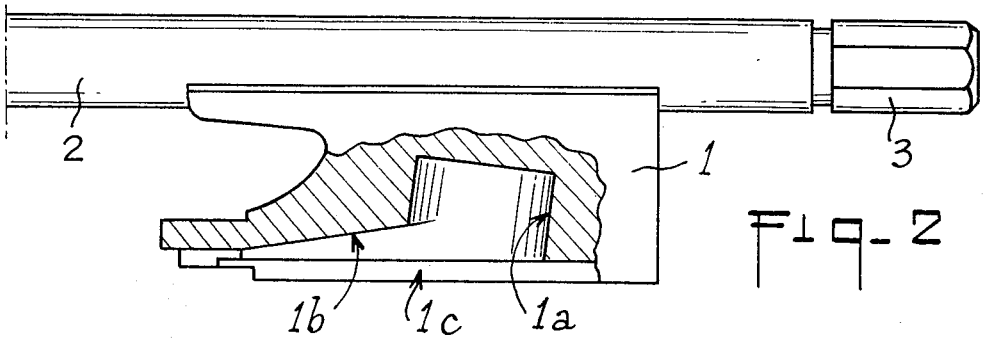
FIG. 2 is a view similar to that of FIG. 1, the nut being shown prior to the fixing of the end of the hair.
Figure 1:
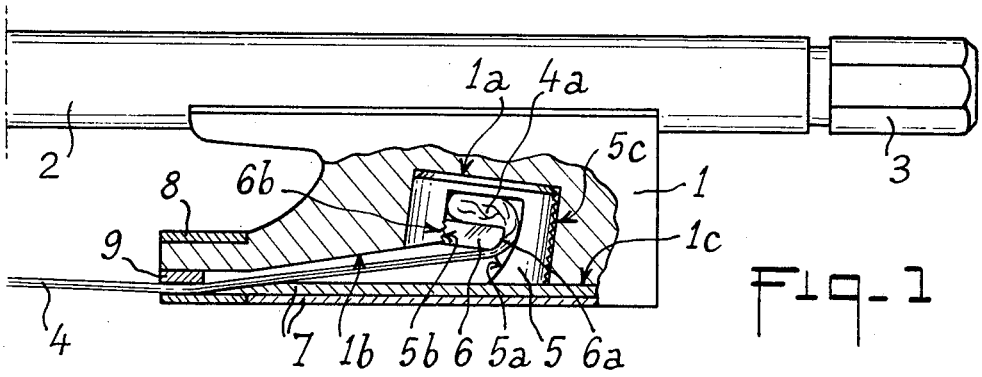
FIG. 1 is a side view, with part longitudinal section, of the nut of a bow in accordance with the invention.

Referring now to the drawings, and in FIGS. 1 and 2 to begin with, reference 1 designates the nut of a bow in accordance with the invention, said bow being constituted by a stick 2 whose end is provided with a screw cap 3 for the conventional adjustment of the longitudinal position of said nut.

Prior to its assembly on the bow, the nut 1, made of wood or other material of suitable nature, is subjected to a milling and machining operation to form a cavity 1*a* opening out on the face of said nut opposite that applied against the stick 2. The cavity 1*a* extends forwardly by an oblique ramp 1*b* whose longitudinal edges are suitably cut at 1*c*. It will be noted that the nut 1 is easily machined with the aid of conventional tools without requiring highly qualified manpower.

Figure 3:
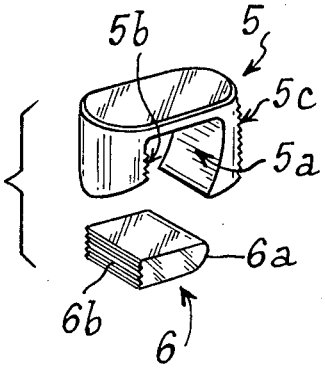
FIG. 3 shows a perspective exploded view of the fixing piece and the corresponding stop.

A series of pieces 5 (FIG. 3) have also been made, of such section as to fit closely inside the cavity 1*a* of each nut. Such a piece 5 may be obtained by moulding, for example in synthetic material of the polystyrene type, or in metal. Such a process of manufacture makes it possible to obtain exact and perfectly regular dimensions and sections, since it is merely a question of suitably shaping the mould. Each piece 5 comprises a housing 5*a* of which one of the side walls is advantageously ribbed, as shown at 5*b*; the outer wall of the piece which is intended to face the rear once assembled in the cavity 1*a* of the nut 1, is itself grooved or serrated at 5*c*.

The piece 5 may be fixed in the cavity 1*a* in any suitable manner; gluing is advantageously effected, the grooves 5*c* improving the retaining effect. When the hair 4 is being assembled on the bow, the twisted end 4*a* thereof is introduced into the housing 5*a* of the piece 5 and is held in place by a stop 6. Said latter is itself made by moulding and has a rounded rear edge 6*a* and a serrated front edge 6*b* intended to cooperate with the grooves 5*b* of the piece 5. Of course, the dimensions of the stop 6 are very precise, with the result that said stop may be retained in the housing 5*a* by simple wedging, without any prior rectification.

The finishing touches are made to the nut in the usual manner, plates 7 being housed in the above-mentioned longitudinal cut-out portions 1*c*. The whole is completed by a wedge 9 supporting the hair 4 as it leaves the nut, said wedge being held in position by a metal collar 8.

Figure 4:
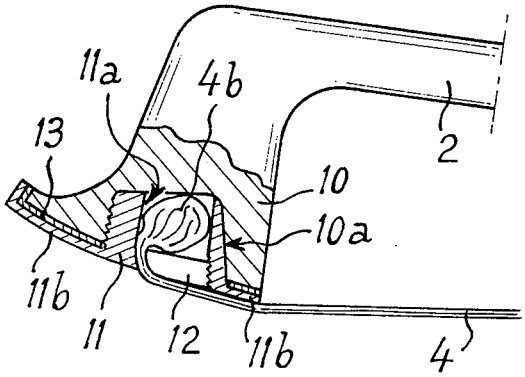
FIG. 4 is a part section illustrating the assembly of the end of the hair on the head of the bow.

The opposite end 4*b* of the hair 4 (FIG. 4) is assembled on the head 10 of the bow in the same manner as described hereinabove with regard to the nut 1. A cavity 10*a* is made in the head 10, inside which is then fixed a piece 11 made of moulded material. The twisted end 4*b* of the hair is introduced into the housing 11*a* of this piece 11 and is fixed by a stop 12 retained by wedging. There again, the operations may all be effected very simply with normal manpower, since the elements which require a very high precision, namely pieces 11 and 12, are made by moulding.

The piece 11 may be fixed in the cavity 10*a* by gluing. With a view to giving the head obtained the appearance of heads of conventional bows, a layer 13, black in colour, may be provided beneath the projecting side parts 11*b* of the piece 11, which appears on the sides of the bow and simulates the appearance of the usual ebony. Of course, the piece 11 is advantageously made of a material having the appearance of ivory.

What is claimed is:

1. A bow for a stringed musical instrument having a stick, a nut end and a head end, at least one of said nut end and said head end having a cavity opening out on the side opposite said stick, means for blocking the hair consisting of a molded element of such outer configuration that it fits within the walls of said cavity, said molded element having a housing and a stop in said housing, the stop having a rounded rear edge and being held within said housing by said rear edge and the opposite front edge, the hair being held between the internal rear facing of the housing of said molded element and the rear edge of said stop.

2. The bow according to claim 1 wherein said molded element has serrations in the outer rear wall.

3. A bow according to claim 1 wherein said molded element has serrations in the front inner face and said stop has serrations in its front edge for engagement with the serrations in the front inner face of the molded element.

4. A bow according to claim 1 wherein said molded element is glued in said cavity.

5. A bow according to claim 1 wherein said cavity in the nut end has an oblique ramp in the forward end.

* * * * *